US009968977B2

(12) United States Patent
Marks et al.

(10) Patent No.: US 9,968,977 B2
(45) Date of Patent: May 15, 2018

(54) METHOD OF SHAPING A COMPONENT

(71) Applicant: GM GLOBAL TECHNOLOGY OPERATIONS LLC, Detroit, MI (US)

(72) Inventors: Kevin R. Marks, Durand, MI (US); Thomas M. Foreman, Parma, OH (US); Tom Sherwood, Auburn Hills, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 450 days.

(21) Appl. No.: 14/791,601

(22) Filed: Jul. 6, 2015

(65) Prior Publication Data

US 2017/0008059 A1 Jan. 12, 2017

(51) Int. Cl.

| | |
|---|---|
| ***C21D 8/02*** | (2006.01) |
| ***C21D 9/46*** | (2006.01) |
| ***B21D 22/02*** | (2006.01) |
| ***B21D 35/00*** | (2006.01) |

(52) U.S. Cl.

CPC ..... *B21D 22/022* (2013.01); *B21D 35/001* (2013.01); *B21D 35/007* (2013.01); *C21D 9/46* (2013.01)

(58) Field of Classification Search

CPC ..... C21D 8/02; C21D 8/0205; C21D 9/46
USPC ..... 148/559, 604
See application file for complete search history.

(56) References Cited

U.S. PATENT DOCUMENTS

| | | | |
|---|---|---|---|
| 5,918,359 | A | 7/1999 | Neuenschwander |
| 2013/0020000 | A1 | 1/2013 | Carter |
| 2013/0202989 | A1 | 8/2013 | Fly et al. |

FOREIGN PATENT DOCUMENTS

| | | | |
|---|---|---|---|
| CN | 1970181 | A | 5/2007 |
| CN | 102665955 | A | 9/2012 |
| CN | 104204251 | A | 12/2014 |
| CN | 104227211 | A | 12/2014 |

*Primary Examiner* — Brian Walck
(74) *Attorney, Agent, or Firm* — Quinn IP Law

(57) ABSTRACT

A method of shaping a component includes providing a plurality of work-piece blanks. The method also includes generating a contour in each work-piece blank, such that each contour is bordered by a region of material of the respective work-piece blank. The method also includes stacking the work-piece blanks such that the contour of one work-piece blank is aligned with the contours of the other blanks. The method additionally includes simultaneously annealing the region of material bordering the respective contour of each stacked work-piece blank to thereby enhance formability of the region of material. Furthermore, the method includes forming a shape in at least one of the work-piece blanks via stretching the annealed region of material bordering the respective contour to thereby shape at least one component. The component can be a structural reinforcement for a vehicle.

18 Claims, 3 Drawing Sheets

METHOD OF SHAPING A COMPONENT

TECHNICAL FIELD

The present disclosure relates to a method of shaping a component.

BACKGROUND

Stamping is a manufacturing process used for forming specifically shaped components from work-piece blanks stamping generally includes such forming operations as punching, blanking, embossing, bending, flanging, and coining. The process of stamping typically employs a machine press to shape or cut the work-piece blank by deforming it with a die.

The stamping process could be a single stage operation where every stroke of the press produces the desired form on the work-piece, or could occur through a series of stages. Although the stamping process is usually carried out on sheet metal, it can also be used to form components from other materials, such as polystyrene.

Stamping of a work-piece into a desired shape is frequently limited by the ability of the work-piece to withstand deformation without developing splits and tears. Annealing can be used in such cases to improve ductility of the work-piece for being formed into the desired shape.

SUMMARY

A method of shaping a component includes initially providing a plurality of work-piece blanks. The method also includes generating a contour in each work-piece blank, such that each contour is bordered by a region of material of the respective work-piece blank. According to the method, a contour of one work-piece blank can be substantially identical to contours of the other work-piece blanks. The method also includes stacking the work-piece blanks such that the contour of one work-piece blank is aligned with the contours of the other work-piece blanks. The method additionally includes simultaneously annealing the region of material bordering the respective contour of each stacked work-piece blank to thereby enhance formability of the subject region of material. Furthermore, the method includes forming a shape in at least one of the work-piece blanks via stretching the annealed region of material bordering the respective contour to thereby shape at least one component.

The act of generating the contour into each of the plurality of work-piece blanks may be accomplished in absence of laser cutting. Furthermore, the act of generating the contour into each of the plurality of work-piece blanks may be accomplished via die-cutting.

The act of stacking the plurality of work-piece blanks may be accomplished by arranging the work-piece blanks in a vertical column. Such a vertical column may include between 350 and 450 work-piece blanks.

The act of forming the shape in at least one of the work-piece blanks can be accomplished individually on each work-piece blank in a transfer press.

The act of simultaneously annealing the region of material of each of the stacked work-piece blanks may be accomplished via an induction coil.

The act of simultaneously annealing the region of material of each of the stacked work-piece blanks via the induction coil may be accomplished at a temperature in the range of 675-800 degrees Celsius.

The material of each respective work-piece blank may be an advanced high-strength steel (AHSS). The AHSS may be a dual-phase steel.

Each of the work-pieces may be a structural reinforcement component for a motor vehicle.

The above features and advantages, and other features and advantages of the present disclosure, will be readily apparent from the following detailed description of the embodiment(s) and best mode(s) for carrying out the described disclosure when taken in connection with the accompanying drawings and appended claims.

DETAILED DESCRIPTION

Figure 1:
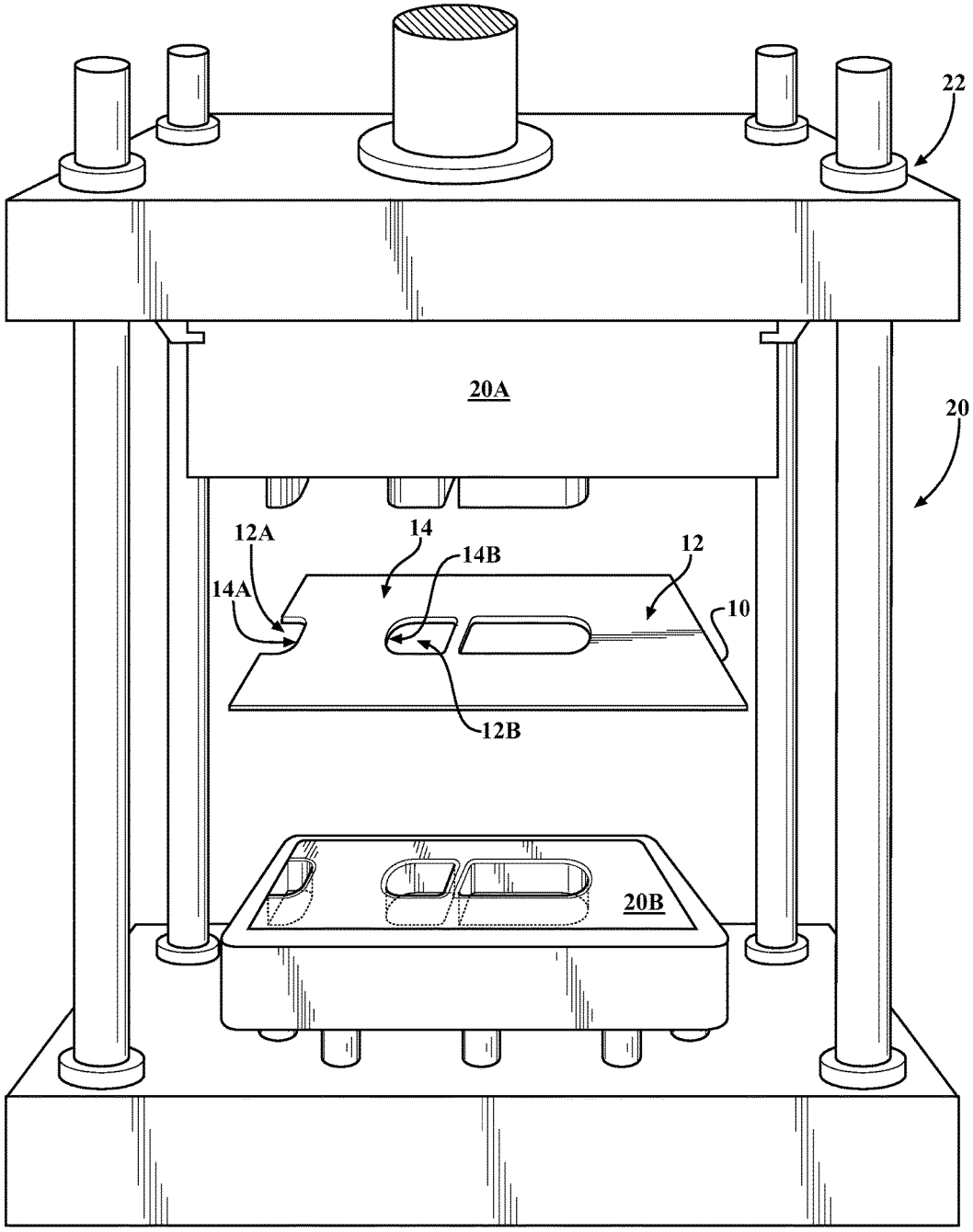
FIG. 1 is a schematic illustration of a contour being cut within a representative work-piece blank.
Figure 2:
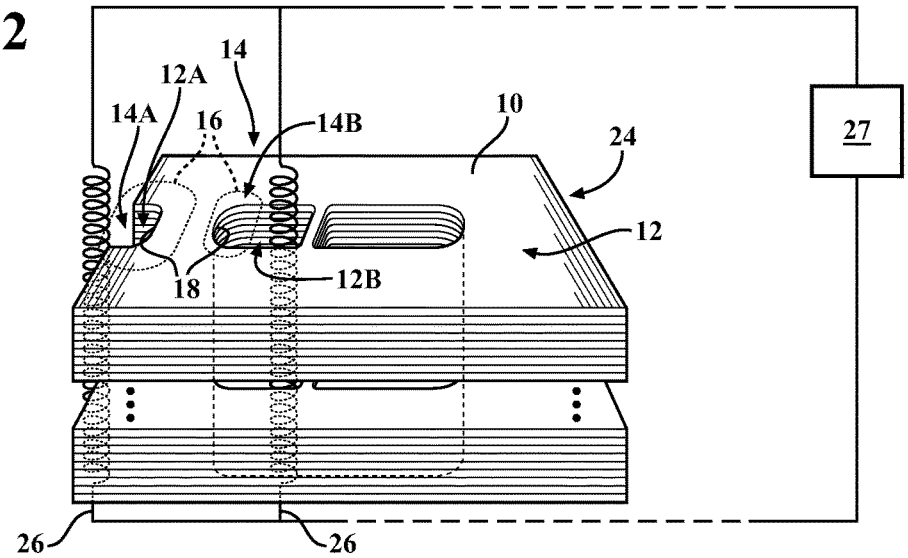
FIG. 2 is a schematic illustration of work-piece blanks, such as shown in FIG. 1, being stacked and a material thereof bordering the contour being annealed.
Figure 3:
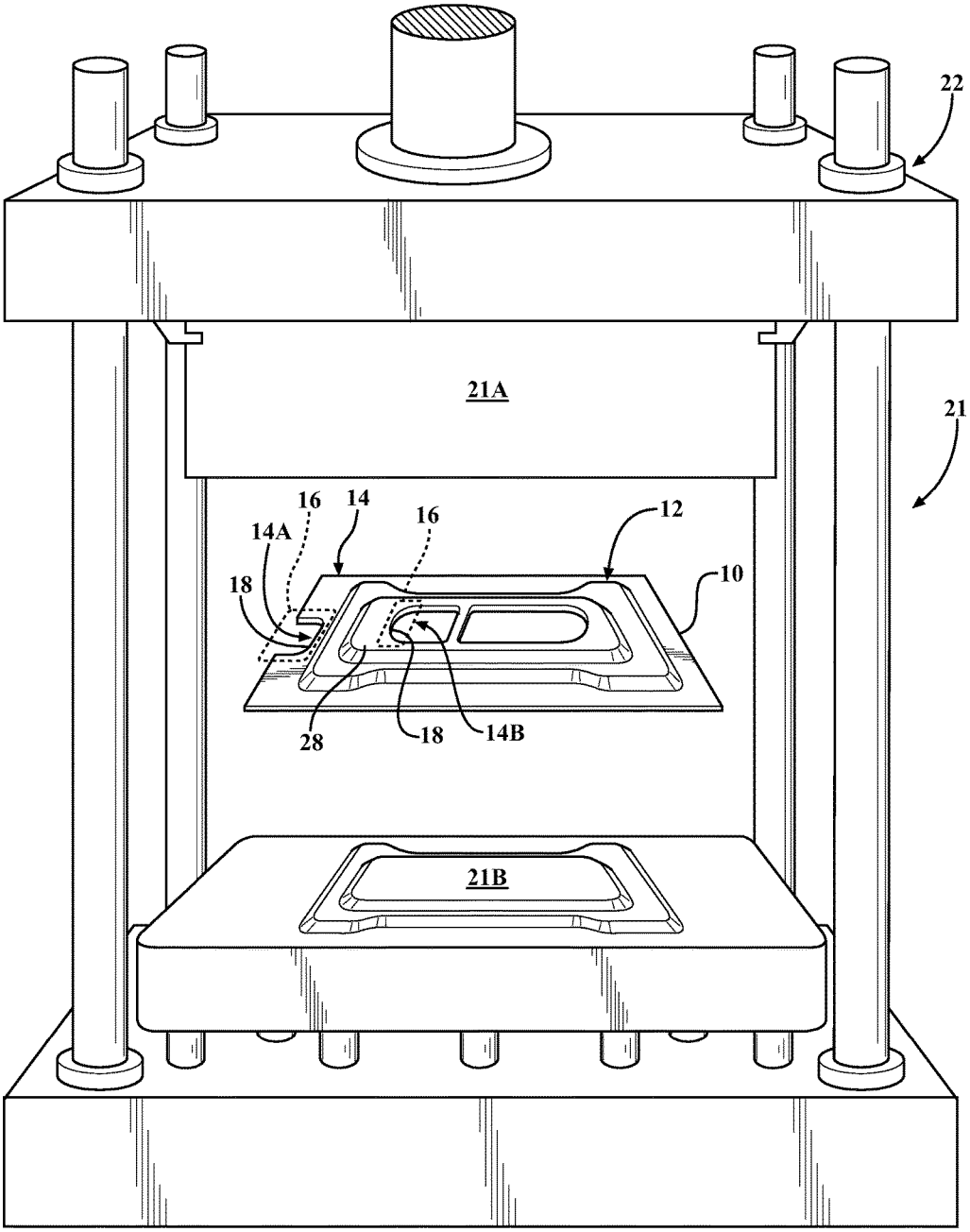
FIG. 3 is a schematic illustration of forming a component from the representative work-piece blank following the annealing shown in FIG. 2.

Referring to the drawings in which like elements are identified with identical numerals throughout, FIGS. 1-3 illustrate, in detail, processing, such as shaping, of a plurality of work-piece blanks 10. Such work-piece blanks 10 are frequently used in manufacturing processes such as metal stamping used to form specifically shaped components. Each work-piece blank 10 is typically a pre-cut piece of sheet metal, such as cold rolled steel. Specifically, a material 12 of the subject work-piece blanks 10 may be Advanced High-Strength Steel (AHSS).

AHSS is a specific variety of alloyed steel that is both strong and ductile. There are several commercially available grades of AHSS. One such grade of AHSS is dual-phase steel, which is heat treated to contain both a ferritic and martensitic microstructure to produce a formable, high strength steel. Another type of AHSS is Transformation Induced Plasticity (TRIP) steel, which involves special alloying and heat treatments to stabilize amounts of austenite at room temperature in normally austenite-free low-alloy ferritic steels. By applying strain to the TRIP steel, the austenite is caused to undergo a phase transition to martensite without addition of heat. Yet another variant of AHSS is Twinning Induced Plasticity (TWIP) steel, which uses a specific type of strain to increase the effectiveness of work hardening on the alloy. AHSS is especially beneficial for structural components used in motor vehicles. AHSS permits structural components of motor vehicles to maintain required strength while using a smaller amount of material.

Dual-phase steels offer a beneficial combination of strength and drawability or formability as a result of their microstructure, in which a hard martensitic or bainitic phase is dispersed in a soft ferritic matrix. Dual-phase steels also have high strain hardenability. High strain hardenability, in turn, gives dual-phase steels good strain redistribution capacity and drawability, as well as finished part mechanical properties, including yield strength, that are superior to those of the initial work-piece, for example the work-piece blank 10. Additionally, the composition and processing of dual-phase steels are specifically designed to promote a significant increase in yield strength during low-temperature heat treatment, such as paint baking or bake hardening (BH).

High finished part mechanical strength lends dual-phase steels excellent fatigue strength and good energy absorption capacity, making these steels suitable for use in structural components and reinforcements. The strain hardening capacity of dual-phase steels combined with a strong bake hardening effect gives them excellent potential for reducing the weight of structural components. Given their high energy absorption capacity and fatigue strength, cold rolled dual-phase steels are particularly well suited for automotive structural and safety parts such as longitudinal beams, cross members and reinforcements. A 780 cold rolled dual-phase steel, i.e., the subject dual-phase steel having a tensile strength of 780 MPa, is recommended for high-strength structural parts responsible for energy management, especially in situations when formability requirements are higher than offered by equivalent grades of conventional high-strength low-alloy (HSLA) steel.

In some cases, to produce a needed final shape from each work-piece blank 10, a contour 14 is first generated by removing from each work-piece blank a material section 12A and/or a material section 12B. The contour 14 of each work-piece blank 10 is intended to be substantially identical to the respective contours of every other subject work-piece blank. As a result, in each work-piece blank 10, the contour 14 is bordered by a region 16 of the material 12. The removal of the material section 12A generates a specific external outline 14A, while the removal of the material section 12B generates an aperture or enclosed cut 14B. As shown in FIG. 1, each of the external outline 14A and the aperture 14B is bordered by the respective region 16 that includes a material edge 18. As shown, the external outline 14A is delineated by the region 16 in the respective work-piece blank 10 such that the material 12 defines the respective external outline by the material edge 18. Furthermore, in the case of the aperture 14B, the material edge 18 of each work-piece blank 10 extends for 360 degrees around the aperture, i.e., the material 12 surrounds and defines the aperture. The plurality of work-piece blanks 10 can be processed individually to generate the required contour 14.

During subsequent forming of the work-piece blank 10, the region 16 bordering the respective contours 14 in the work-piece blanks 10 can be subject to tensile load and significant hoop strain via stretching the annealed region at the material edge 18. As a result, during subsequent forming, the region 16 can develop edge fractures, cracks, or tears, which can lead to increased scrap rates of the work-piece blanks 10 and reduce robustness of finished components. Such a concern is especially likely when the material 12 of the work-piece blanks 10 is AHSS.

Using a laser to cut the contour 14 in the work-piece blank 10 can reduce the probability of fractures in the material edge 18 of the region 16. However, laser cutting of the contour 14 in the work-piece blank 10 consumes significant amount of time and energy, and is detrimental to productivity. Die-cutting of the contour 14 in the work-piece blank 10 is much more economical. Local annealing of the material 12 bordering the respective contour 14 of the work-piece blank 10 can be used to reduce the probability of fractures in the material edge 18 of the region 16. However, annealing of individual work-piece blanks 10 consumes a significant amount of time and energy, and is also detrimental to productivity.

To overcome the above difficulties, initially, the contour 14 is generated by cutting the material section 12A out of each work-piece blank 10 sans, i.e., in absence of, laser cutting. Specifically, the contour 14 may be generated via a die 20, having an upper die 20A and a lower die 20B (as shown in FIG. 1), such as by blanking or stamping out the material section 12A in a press 22. Following the generation of the contour 14, a plurality of work-piece blanks 10 can be stacked in vertical columns, i.e., arranged in stacks 24 of hundreds of blanks, such as multiples in the range of 350 to 450 blanks, such that the contour 14 of one work-piece blank is aligned with the contours of the other work-piece blanks in the subject stack.

Following the arrangement of the plurality of work-piece blanks 10 in the stack 24, the region 16 of material 12 bordering the respective contour 14 of each of the work-piece blanks can be simultaneously locally annealed using one or more induction coils 26 connected to an appropriate power supply 27 (as shown in FIG. 2). Such simultaneous annealing of the region 16 of each of the stacked work-piece blanks 10 via the induction coil(s) 26 is intended to enhance formability of the region, and may be accomplished at temperature in the range of 675-800 degrees Celsius. Following such simultaneous annealing of the region 16 in each of the work-piece blanks 10, a predetermined shape 28 can be formed in each work-piece blank, such as by the material 12 at the region 16 being drawn via a die 21, having an upper die 21A and a lower die 21B (as shown in FIG. 3). The shape 28 can be formed in the region 16 while the possibility of fractures, etc. is minimized, despite the fact that the material 12 in the region 16 may be subjected to stretching and considerable hoop strain. The shape 28 can be formed into each individual work-piece blank 10 using a progressive die in a transfer press (not shown), to thereby produce desired components, such as structural reinforcements for motor vehicles.

Figure 4:
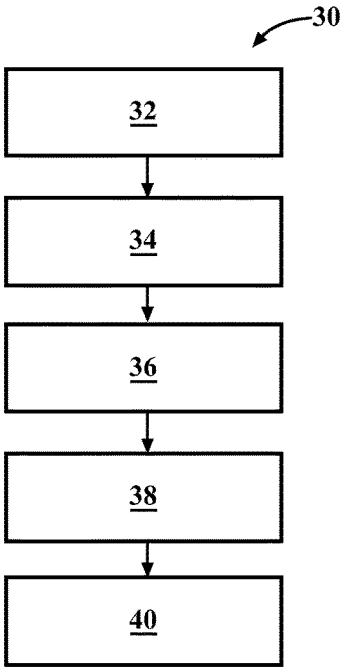
FIG. 4 is a flow chart illustrating a method of shaping a component.

FIG. 4 depicts a method 30 of producing a component having the shape 28, e.g., shaping a structural reinforcement for a motor vehicle (which is not shown, but understood by those skilled in the art), as described above with respect to FIGS. 1-3. The method 30 commences in frame 32 where it includes providing a plurality of work-piece blanks 10, and then proceeds to frame 34. In frame 34, the method includes generating the contour 14 in each of the plurality of work-piece blanks 10, such that each contour is bordered by the region 16 of material 12 of the respective work-piece blank. As described above with respect to FIGS. 1-3, the contours 14 can be cut out of the respective work-piece blanks 10 sans laser cutting, and may be generated via a die-cutting operation. After frame 34, the method advances to frame 36. In frame 36, the method includes stacking the plurality of work-piece blanks 10, such that the contour 14 of one work-piece blank is aligned with the contours of the other work-piece blanks. The stacking of the work-piece blanks 10 may be accomplished by arranging the work-piece blanks in a vertical column, such that the column includes between 350 and 400 of the work-piece blanks.

Following the stacking of the plurality of work-piece blanks 10, the method proceeds to frame 38. In frame 38, the method includes simultaneously annealing the region 16 of material 12 bordering the respective contour 14 of each of the stacked work-piece blanks 10 to thereby enhance formability of subject region. The simultaneous annealing the region of material 12 of each of the stacked work-piece blanks 10 may be accomplished via the induction coil(s) 26 at a temperature in the range of 675-800 degrees Celsius. After frame 38, the method advances to frame 40 where it includes forming the shape 28 in at least one of the work-piece blanks 10 via stretching the annealed region 16 of material bordering the respective contour 14 to thereby generate at least one component having the subject shape. As described above with respect to FIGS. 1-3, the material of each respective work-piece blank 10 may be advanced high-strength sheet steel (AHSS), for example the 780 dual-phase steel. Consistent with the disclosure, the representative component thus formed from each work-piece blank 10 and having the shape 28 may be a structural reinforcement for a motor vehicle.

The detailed description and the drawings or figures are supportive and descriptive of the disclosure, but the scope of the disclosure is defined solely by the claims. While some of the best modes and other embodiments for carrying out the claimed disclosure have been described in detail, various alternative designs and embodiments exist for practicing the disclosure defined in the appended claims. Furthermore, the embodiments shown in the drawings or the characteristics of various embodiments mentioned in the present description are not necessarily to be understood as embodiments independent of each other. Rather, it is possible that each of the characteristics described in one of the examples of an embodiment can be combined with one or a plurality of other desired characteristics from other embodiments, resulting in other embodiments not described in words or by reference to the drawings. Accordingly, such other embodiments fall within the framework of the scope of the appended claims.

The invention claimed is:

1. A method of shaping a component, the method comprising:

providing a plurality of work-piece blanks;

generating a contour in each of the plurality of work-piece blanks, such that each contour is bordered by a region of material of the respective work-piece blank;

stacking the plurality of work-piece blanks, such that the contour of one work-piece blank is aligned with the contours of the other work-piece blanks;

simultaneously annealing the region of material bordering the respective contour of each of the stacked work-piece blanks; and forming a shape in at least one of the work-piece blanks via stretching the annealed region of material bordering the respective contour to thereby shape the component, wherein said forming the shape is accomplished individually on each of the work-piece blanks in a transfer press.

2. The method of claim 1, wherein said generating the contour in each of the plurality of work-piece blanks is accomplished sans laser cutting.

3. The method of claim 2, wherein said generating the contour in each of the plurality of work-piece blanks is accomplished via die-cutting.

4. The method of claim 1, wherein said stacking the plurality of work-piece blanks is accomplished by arranging the work-piece blanks in a vertical column.

5. The method of claim 4, wherein the vertical column includes between 350 and 450 of the work-piece blanks.

6. The method of claim 1, wherein said simultaneously annealing the region of material of each of the stacked work-piece blanks is accomplished via an induction coil.

7. The method of claim 6, wherein said simultaneously annealing the region of material of each of the stacked work-piece blanks via the induction coil is accomplished at a temperature in the range of 675-800 degrees Celsius.

8. The method of claim 1, wherein the material of each respective work-piece blank is an advanced high-strength steel (AHSS).

9. The method of claim 8, wherein the AHSS is a dual-phase steel.

10. The method of claim 1, wherein the component is a structural reinforcement for a motor vehicle.

11. A method of shaping a structural reinforcement for a motor vehicle, the method comprising:

providing a plurality of work-piece blanks;

generating a contour in each of the plurality of work-piece blanks, such that each contour is bordered by a region of material of the respective work-piece blank;

stacking the plurality of work-piece blanks, such that the contour of one work-piece blank is aligned with the contours of the other work-piece blanks;

simultaneously annealing the region of material bordering the respective contour of each of the stacked work-piece blanks; and forming a shape in at least one of the work-piece blanks via stretching the annealed region of material bordering the respective contour to thereby shape the structural reinforcement, wherein said forming the shape is accomplished individually on each of the work-piece blanks in a transfer press.

12. The method of claim 11, wherein said generating the contour into each of the plurality of work-piece blanks is accomplished sans laser cutting.

13. The method of claim 12, wherein said generating the contour into each of the plurality of work-piece blanks is accomplished via die-cutting.

14. The method of claim 11, wherein said stacking the plurality of work-piece blanks is accomplished by arranging the work-piece blanks in a vertical column.

15. The method of claim 14, wherein the vertical column includes between 350 and 450 of work-piece blanks.

16. The method of claim 11, wherein said simultaneously annealing the region of material of each of the stacked work-piece blanks is accomplished via an induction coil.

17. The method of claim 16, wherein said simultaneously annealing the region of material of each of the stacked work-piece blanks via the induction coil is accomplished at a temperature in the range of 675-800 degrees Celsius.

18. The method of claim 11, wherein the material of each respective work-piece blank is a dual-phase advanced high-strength steel (AHSS).

* * * * *